US005741994A

United States Patent [19]

Takeuchi

[11] Patent Number: 5,741,994

[45] Date of Patent: Apr. 21, 1998

[54] WAVEGUIDE MUSICAL TONE SYNTHESIZING APPARATUS WITH NOISE MODULATION OF WAVEGUIDE COUPLING

[75] Inventor: Chifumi Takeuchi, Hamamatsu, Japan

[73] Assignee: Yamaha Corporation, Japan

[21] Appl. No.: 607,793

[22] Filed: Feb. 27, 1996

[30] Foreign Application Priority Data

Feb. 28, 1995 [JP] Japan ..... 7-040612

[51] Int. Cl.[6] ..... G10H 1/08

[52] U.S. Cl. ..... 84/660; 84/DIG. 10

[58] Field of Search ..... 84/624, 659–661, 84/DIG. 9, DIG. 10

[56] References Cited

U.S. PATENT DOCUMENTS 5,212,334 5/1993 Smith .
5,223,653 6/1993 Kunimoto et al. .
5,359,146 10/1994 Funaki et al. ..... 84/624
5,382,751 1/1995 Kitayama et al. ..... 84/661

*Primary Examiner*—Stanley J. Witkowski
*Attorney, Agent, or Firm*—Graham & James LLP

[57] ABSTRACT

A musical tone-synthesizing apparatus has a plurality of waveguide networks each including at least one waveguide, each of which has a closed loop in which a circulating signal circulates in response to an external excitation signal. The closed loop has an output through which the circulating signal is output as a waveguide output signal, and an input port through which a signal is input to be superposed on the circulating signal. A network output signal is formed based on the waveguide output signal. A connection means is connected to corresponding ones of the waveguide networks and carries out signal processing on the network output signal delivered from each of the corresponding waveguide networks, based on an external modulating signal, and inputs the resulting processed signal to the input port of the closed loop of each of the corresponding waveguide networks.

5 Claims, 5 Drawing Sheets

WAVEGUIDE MUSICAL TONE SYNTHESIZING APPARATUS WITH NOISE MODULATION OF WAVEGUIDE COUPLING

BACKGROUND OF THE INVENTION

1. Field of the Invention

This invention relates to a musical tone-synthesizing apparatus, and more particularly to a musical tone-synthesizing apparatus utilizing waveguide networks each comprised of a plurality of waveguides, for synthesizing musical tone signals.

2. Prior Art

Conventionally, in electronically synthesizing signals of sounds of percussion instruments, a waveform memory tone generator employing the pulse code modulation (PCM) method has been widely used. This is because a sound generated by a percussion instrument is not continuous, i.e. attenuates soon, and further it does not require pitch control to synthesize a percussion sound, but only requires scanning a memory device at a constant speed in response to a trigger signal to read out sampled music tones to synthesize a high-quality musical tone signal.

However, an actual percussion instrument generates a sound which largely varies with tuning of the instrument, a manner of performance, beating points, etc. The PCM tone generator, however, is only capable of repeatedly generating the same sound whenever it is generated, and hence it is difficult to synthesize a sound which varies just like an actual musical sound generated by a percussion instrument.

To overcome this problem, a tone generator using waveguides has recently been proposed, which is capable of generating sounds of percussion instruments. The waveguide is an electric circuit which simulates a vibration-transmitting media, such as leather of a drum, a string of a string instrument, and an air column of a wind instrument by means of a go and return or loop signal propagation circuit including delay circuits, filters, etc. The waveguide may also be realized by a software program working on a digital signal processor.

A waveguide network formed of a plurality of waveguides connected to each other are suitable for synthesizing sounds produced by cymbals, a tom tom (drum in the form of a hollow cylinder covered with leather on opposite ends thereof), and other drum sounds.

Hi-hat cymbals of a drum set is formed of two cymbals for sounding musical tones through mutual actions exerting influence on each other. To synthesize musical tones generated by a musical instrument of such a type that a plurality of vibrating elements complicatedly exert influence on each other or mutually interfere to generate musical tones, it is important to simulate attenuation of vibrations, mutual reactions, etc. caused by colliding of the vibrating elements with each other. It has, however, been difficult for the conventional waveguide network to perform such a simulation.

SUMMARY OF THE INVENTION

It is an object of the invention to provide a musical tone-synthesizing apparatus which is capable of synthesizing musical tones produced by a musical instrument of the type that a plurality of vibrating elements complicatedly exert influence on each other or mutually interfere to generate musical tones.

To attain the above object, the present invention provides a musical tone-synthesizing apparatus comprising a plurality of waveguide networks each including at least one waveguide, each of the at least one waveguide having a closed loop in which a signal circulates as a circulating signal in response to an external excitation signal, the closed loop having an output through which the circulating signal is output as a waveguide output signal, and an input through which a signal is input to be superposed on the circulating signal, and signal-forming means for forming a network output signal based on the waveguide output signal from the closed loop of the each of the at least one waveguide through the output thereof, and connection means connected to corresponding ones of the waveguide networks, for carrying out signal processing on the network output signal delivered from each of the corresponding ones of the waveguide networks, based on an external modulating signal, and for inputting the resulting processed signal to the input of the closed loop of at least one of the at least one waveguide of said each of said corresponding ones of the waveguide networks.

Preferably, the musical tone-synthesizing apparatus according to the invention includes modulating signal-generating means for carrying out signal processing on a noise signal to form the modulating signal.

Alternatively or together with the above modulating signal-generating means, the musical tone-synthesizing apparatus according to the invention includes modulating signal-generating means for carrying out signal processing on the network output signal from one of the corresponding ones of said waveguide networks to form the modulating signal.

Preferably, the connection means includes a connection block having a closed loop, and a plurality of modulating blocks connected, respectively, to the corresponding ones of the waveguide networks, each of the modulating blocks forming a modulation block output signal based on the network output signal from a corresponding one of the corresponding ones of the waveguide networks and the modulating signal and delivering the modulating block output signal to the closed loop of the connection block and the closed loop of the at least one waveguide of the corresponding one of the corresponding ones of the waveform networks, the connection block forming feedback signals based on the modulating block output signal from one of the modulating blocks and the modulating block output signal from another one of the modulating blocks and delivering the feedback signals, respectively, to the another one of the modulating blocks and the one of the modulating blocks, the modulating blocks each mixing the network output signal and the feedback signal at a ratio dependent on the modulating signal to form the modulating block output signal.

More preferably, the feedback signal delivered from the one of the modulating blocks is formed by multiplying the modulating block output signal from the another one of the modulating blocks by a predetermined coefficient, and the feedback signal delivered from the another one of the modulating blocks is formed by multiplying the modulating block output signal from the one of the modulating blocks by a predetermined coefficient.

Alternatively, the feedback signal delivered from the one of the modulating blocks is formed by adding together the modulating block output signal from the one of the modulating blocks and the modulating block output signal from the another one of the modulating blocks, and the feedback signal delivered from the another one of the modulating blocks is formed by adding together the modulating block output signal from the one of the modulating blocks and the modulating block output signal from the another one of the modulating blocks.

The above and other objects, features, and advantages of the invention will become more apparent from the following detailed description taken in conjunction with the accompanying drawings.

DETAILED DESCRIPTION

The invention will now be described in detail with reference to the drawings showing embodiments thereof.

Figure 1:
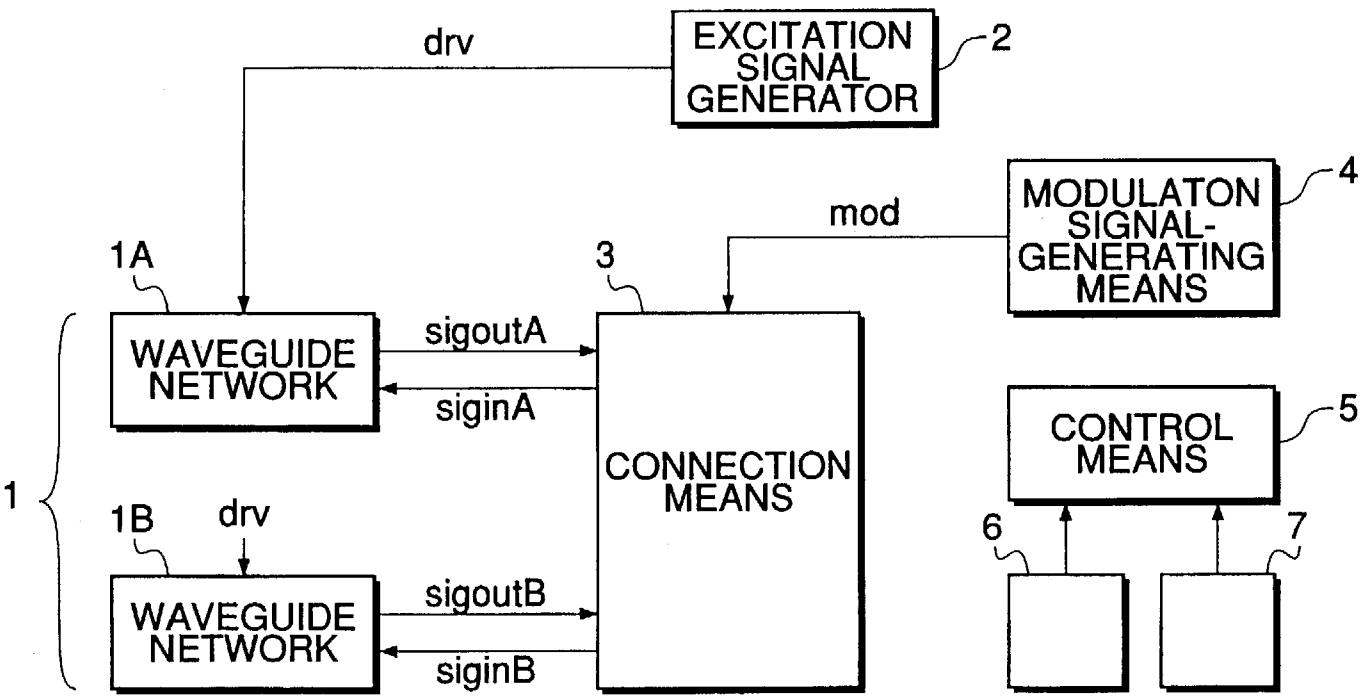
FIG. 1 is a block diagram showing the whole arrangement of a musical tone-synthesizing apparatus according to an embodiment of the invention.

Referring first to FIG. 1, there is shown the whole arrangement of a musical tone-synthesizing apparatus according to an embodiment of the invention, which is comprised of two waveguide networks 1A, 1B, an excitation signal generator 2, connection means 3, modulation signal-generating means 4, and control means 5.

The excitation signal generator generates an excitation or driving signal drv in response to a tone-generating instruction supplied from the control means 5. The excitation signal drv is supplied to both or one of the waveguide networks 1A and 1B.

The waveguide networks 1A, 1B are each comprised of closed-loop signal propagation paths in which tone signals circulate. When the excitation signal drv is applied to the closed-loop signal propagation paths, tone signals are generated and circulate in the propagation paths. The waveguide networks 1 are each provided with a signal output port through which an output signal sigout obtained from the circulating tone signals is delivered to an external device. An output signal from the waveguide network 1A and an output signal from the waveguide network 1B will be designated by sigoutA and sigoutB, respectively, where it is necessary to distinguish between them.

The waveguide networks 1A, 1B are also each provided with a signal input port through which a signal other than the excitation signal drv is input to the closed-loop signal propagation paths. That is, a tone signal sigin can be input through the signal input port. One waveguide network corresponds to one vibrating element of a musical instrument. In the case of hi-hat cymbals, the two waveguide networks correspond to an upper cymbal and a lower cymbal, respectively.

The modulation signal-generating means 4 forms and supplies a modulation signal mod which varies as time elapses. The modulation signal mod is delivered to the connection means 3.

The connection means 3 is supplied with the tone signal sigout taken out from each of the waveguide networks 1A, 1B. The connection means 3 carries out signal processing on the tone signals sigoutA, sigoutB supplied from the two waveguide networks 1A and 1B, as will be described hereinafter. The signal processing is carried out based on the modulation signal mod. The connection means 3 correspond to a connecting portion connecting between two vibrating elements which vibrate while exerting influence on each other.

Tone color-setting means 6 and a performance operating element 7 are connected to the control means 5. The control means 5 instructs the excitation signal generator 2 to generate musical tones based on tone color information supplied from the tone color-setting means 6 and performance information supplied from the performance operating element 7. Further, the control means 5 generates various kinds of control signals. These control signals are delivered to other blocks within the musical tone-synthesizing apparatus.

Next, the arrangement and functions of the waveguide networks 1A, 1B will be described with reference to FIG. 2. The waveguide networks 1A, 1B shown in FIG. 1 are of the same construction, and therefore description will be made of only one of them.

Figure 2:
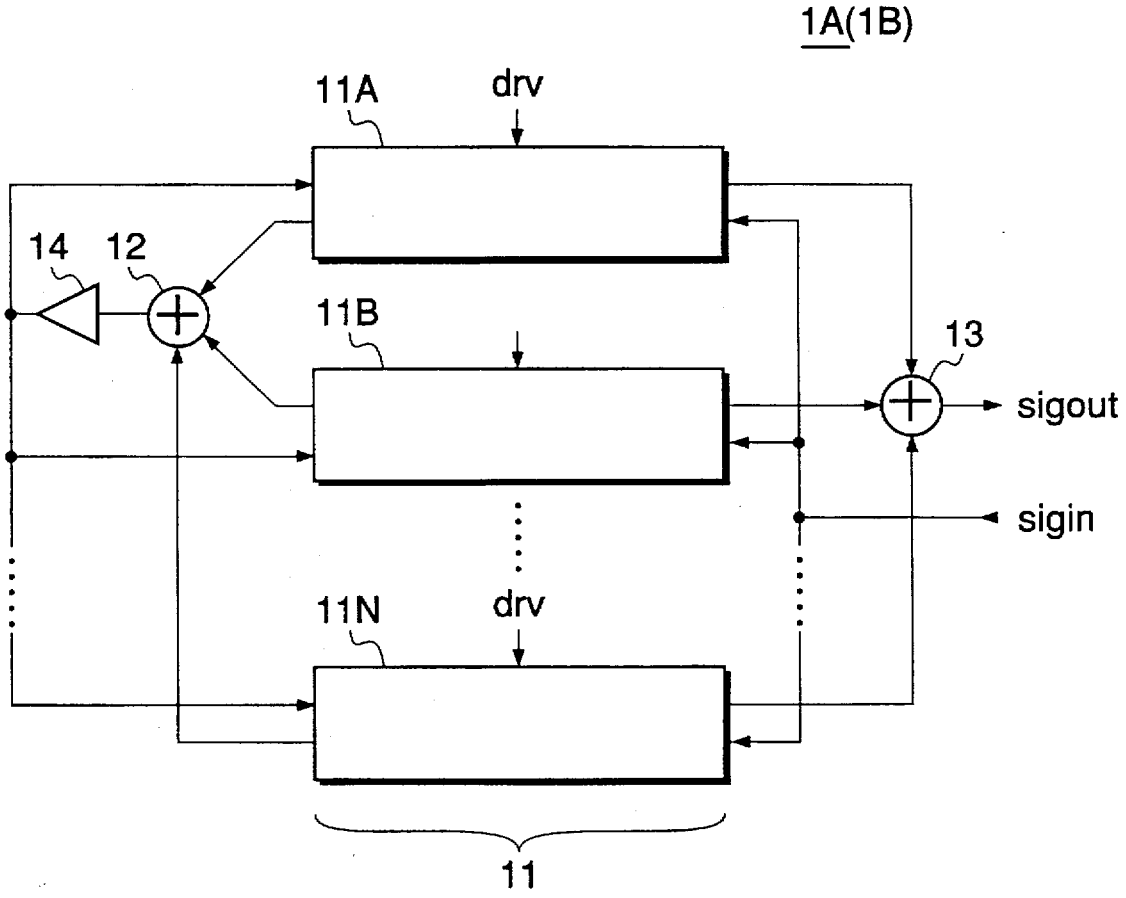
FIG. 2 is a block diagram showing the arrangement of a waveguide network appearing in FIG. 1.

Referring to FIG. 2, the waveguide network 1A is comprised of a plurality of waveguides 11A, 11B, . . . 11N, adders 12, 13 which connect the waveguides with each other, and a multiplier 14. The waveguide networks 1A and 1B may have different numbers of waveguides from each other.

Each waveguide 11 is formed of an outgoing path and a return path through which tone signals propagate, and connection paths which connect between the outgoing path and the return path to form a closed-loop signal propagation path, as will be described in detail with reference to FIG. 3. A signal is input to the outgoing path of each waveguide at the right side, as viewed in the figure, and the signal having propagated through the outgoing path is delivered therefrom at the left side, as viewed in the figure. Further, a signal is input to the return path of the waveguide at the right side, and the signal having propagated through return path is delivered therefrom at the left side.

Each waveguide 11 is supplied with the excitation signal drv for exciting the tone signals in the closed-loop signal propagation path. The excitation signal drv may be applied to only part of a plurality of waveguides 11. Further, as described above with reference to FIG. 1, one of the waveguide networks 1A and 1B may not be supplied with the excitation signal drv.

Output signals from the return paths of the waveguides 11A to 11N are input to the adder 12. The adder 12 adds together these signals and inputs the resulting sum signal to the multiplier 14. The multiplier 14 multiplies the input signal by a predetermined coefficient and delivers the resulting product signal to the outgoing path of each of the waveguides 11A to 11N.

Output signals from the outgoing paths of the waveguides 11A to 11N are input to the adder 13. The adder 13 adds together these signals and outputs the resulting sum signal sigout. The signal sigout is input to the connection means 3, as shown in FIG. 1. On the other hand, the signal signin delivered from the connection means 3 is input to the return path of each of the waveguides 11A to 11N.

Next, details of the arrangement and functions of each waveguide 11 will be described with reference to FIG. 3.

Figure 3:
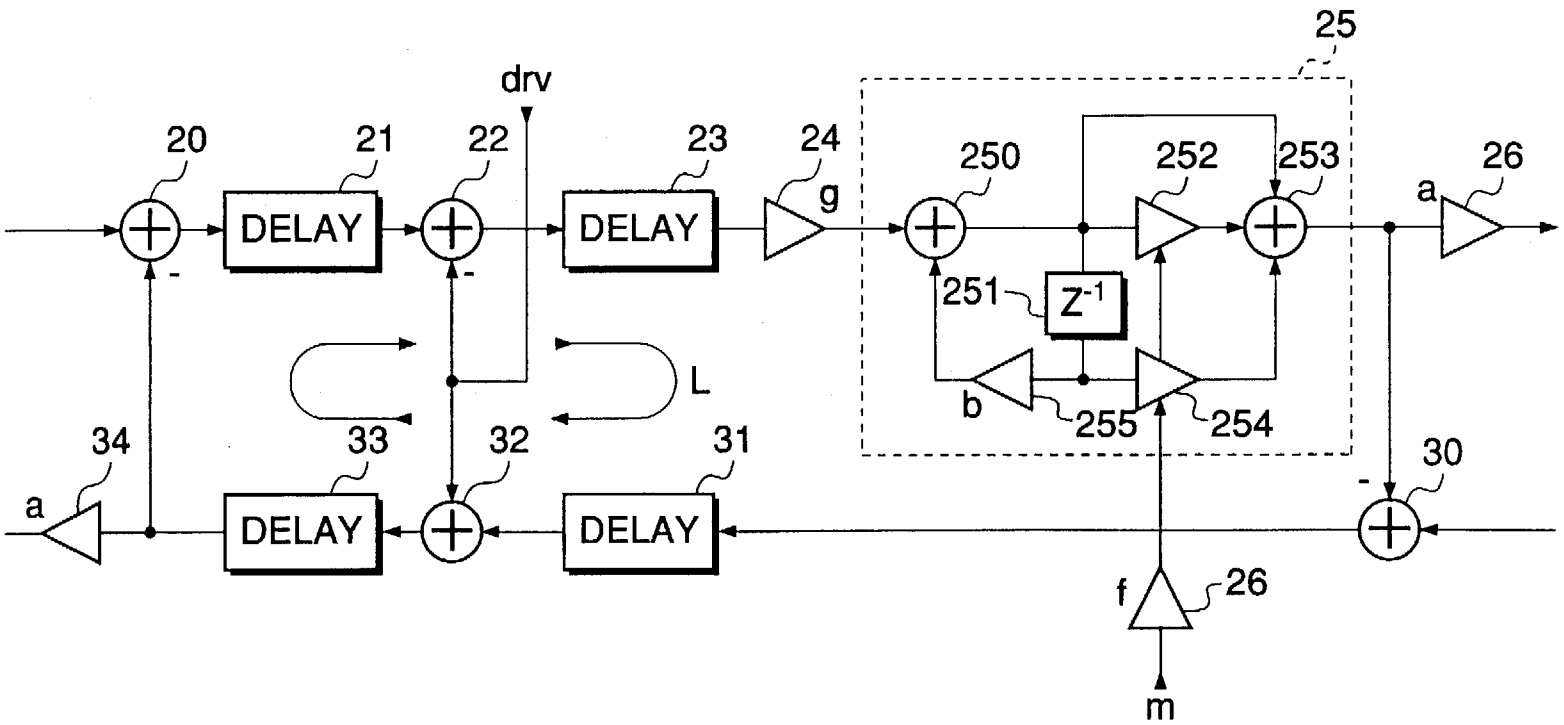
FIG. 3 is a circuit diagram showing the arrangement of an example of a waveguide appearing in the waveguide network of FIG. 2.

FIG. 3 shows, by way of example, the arrangement of the waveguide 11. The waveguide 11 is comprised of an outgoing path through which a signal propagates from the left to the right as viewed in the figure, a return path through which a signal propagates from the right to the left, and connection paths which connect between the outgoing path and the return path to form a closed-loop signal propagation path. The outgoing path has arranged thereon an adder 20, a delay circuit 21, an adder 22, a delay circuit 23, a multiplier 24, a filter 25, and a multiplier 26, which are connected in series in the mentioned order. The return path has arranged thereon an adder 30, a delay circuit 31, an adder 32, a delay circuit 33, and a multiplier 34, which are connected in series in the mentioned order as well.

The adder 20 forms a differential signal between an external signal input to a positive input thereof and an output signal from the delay circuit 33 input to a negative input thereof, and supplies the differential signal to the outgoing path. The adder 30 forms a differential signal between an external signal (designated by sigin in FIG. 2) input to a positive input thereof and an output signal from the filter 25 input to a negative input thereof, and supplies the differential signal to the return path. The closed-loop signal propagation path is formed by thus supplying the signals from the outgoing path and the return path to the negative inputs of the adders 20, 30, respectively.

The delay circuits 21, 23, 31 and 33 represent the length of the signal propagation path and effect delaying of signals according to respective lengths allotted to them. The adders 22 and 32 add the excitation signal drv to the signals propagating in the outgoing path and the return path, respectively. The excitation signal drv corresponds to an impact applied to the cymbal when the cymbals are struck. The multiplier 24 multiplies the signal propagating in the outgoing path by a coefficient g. The coefficient g corresponds to an attenuation factor of the signal propagation path and is supplied from the control means 5 in FIG. 1.

The filter 25 is comprised of an IIR low-pass filter formed of an adder 250, a delay circuit 251, and a multiplier 255, and an FIR filter formed of the delay circuit 251 shared with the IIR filter, multipliers 252, 254, and an adder 253. In the present embodiment, the filter 25 is set to a high-pass characteristic for simulating attenuations caused by the connection of the vibrating elements of the musical instrument.

The delay circuit 251 causes a delay of e.g. one sampling time period. The multiplier 255 has a multiplication coefficient b supplied from the control means 5. The coefficients g and b determine an amount of delay and a decay time which are caused by the waveguide, and a cut-off frequency of the IIR low-pass filter, thereby determining a basic tone color.

The multipliers 252 and 254 have multiplication coefficients determined by an output signal from the multiplier 256. The multiplier 256 multiplies a control signal m supplied from the control means 5 by a multiplication coefficient f to determine the multiplication coefficients of the multipliers 252 and 254. The multiplication coefficient f is determined in advance by the maximum amount of attenuation to occur in an attenuation region of the filter and an amount of delay to be caused by the waveguide, and the control signal m from the control means 5 controls the degree of attenuation to be caused by the filter 25.

The multipliers 26, 34 multiply respective signals having propagated through the outgoing path and the return path by a multiplication coefficient a to deliver the resulting signals to the outside. The multiplication coefficient a is delivered from the control means 5 in FIG. 1. The output signal from the multiplier 26 is input to the adder 13 appearing in FIG. 2, and the output signal from the multiplier 34 to the adder 12 appearing in FIG. 2.

If the sampling frequency is designated by fs, the number of delay stages of the closed-loop signal propagation path by L, the cut-off frequency of the IIR low-pass filter by fc, a time period before the signal propagating through the closed loop attenuates to −60dB by dt, and the amount of attenuation which a sample signal circulating through the loop once undergoes by r, the multiplication coefficients b, g, and f should be set such that they satisfy the conditions expressed by the following equations:

$$b=\exp(-2\pi fc/fs)$$

$$g=(1-b)\times 10^{-3L/dtfs}$$

$$f=(r^{L}-1)/2$$

The number of delay stages L may be variable. To this end, the number of delay stages of the delay circuit 23 or 31 may be varied by a signal from the control means 5.

The multiplication coefficient a is set such that the sum of values of the multiplication coefficient a used in the waveguides 11A to 11N is equal to a predetermined value (1 in the present embodiment).

The waveguide shown in FIG. 3 is merely one example. A waveguide having a different construction may be used instead. Although in the illustrated embodiment, the excitation signal drv is applied to medium points of the outgoing path and the return path which correspond to sides of vibrations, this is not limitative, but it may applied to points corresponding to nodes of vibrations, i.e. ends of the outgoing path and the return path. The drive signal may be also applied to a plurality of points of the outgoing path and the return path. Application of the excitation signal to the plurality of points of the waveguide is equivalent to striking a cymbal at a plurality of points thereof at one time.

Next, the arrangement and functions of the connection means 3 will be described with reference to FIG. 4.

Figure 4:
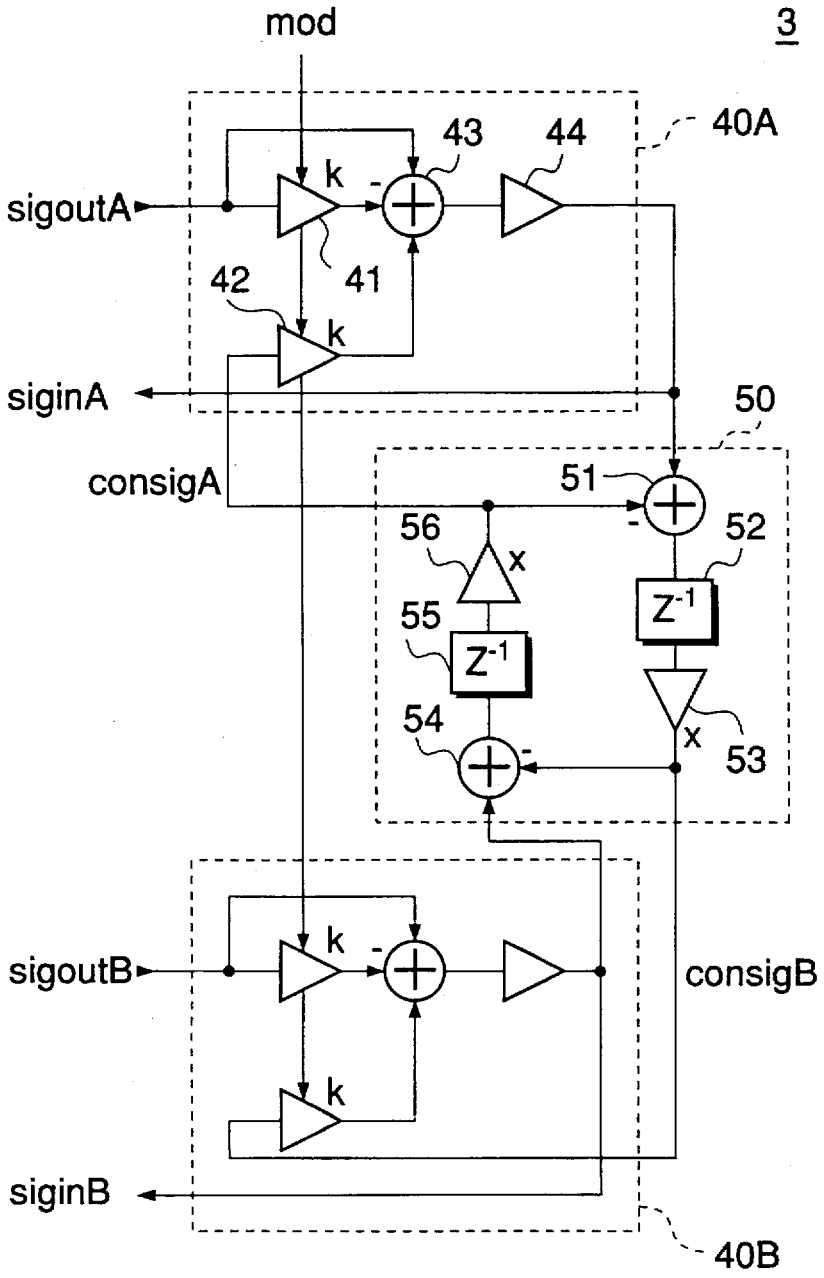
FIG. 4 is a block diagram showing the arrangement of connection means appearing in FIG. 1.

Referring to FIG. 4, the connection means 3 is comprised of modulating blocks 40A, 40B provided respectively for the waveguide networks, and a connecting block 50 connecting between the modulating blocks 40A, 40*b*. The modulating blocks 40A, 40B are of the same construction, and hence description will be made of the modulating block 40A alone.

The modulating block 40A is comprised of two multipliers 41, 42 on the input side, an adder 43, and a multiplier 44 on the output side. The multiplier 41 is supplied with the output signal sigoutA from the waveguide network 1A, and the multiplier 42 is supplied with a signal consigA from the connecting block 50. The multipliers 41, 42 have multiplication coefficients thereof both determined by the output signal mod from the modulation signal-generating means 4.

An output signal from the multiplier 41 is input to a negative input of the adder 43, while an output signal from the multiplier 42 is input to a positive input of the adder 43. The other positive input of the adder 43 is supplied with the output signal sigoutA from the waveguide network 1A.

Assuming that the multipliers 41, 42 both have a multiplication coefficient k, an output signal from the adder 43 is expressed by the following formula:

$$(1-k)\times \text{sigoutA}+k\times \text{consigA}\ (0\leqq k\leqq 1) \qquad (1)$$

Since the multiplication coefficient k is determined by the modulation signal mod, a mixing ratio of the signals sigoutA and consigA can be varied by the modulation signal mod.

The multiplier 44 multiplies the output signal from the adder 43 by 2 to preserve the law of energy conservation of the waveguide network to form the output signal siginA from the modulating block 40A. The output signal siginA is applied to the waveguide network 1A as well as to the connecting block 50.

The connecting block 50 is comprised of an adder 51, a delay circuit 52, a multiplier 53, an adder 54, a delay circuit 55, and a multiplier 56, which are connected to each other in the mentioned order to form a closed-loop signal propagation path. Output signals from the multipliers 53, 56 are input to negative inputs of the adders 54, 51, respectively. The multipliers 53, 56 both have a multiplication coefficient x which determines an attenuation factor of the closed-loop signal propagation path. The multiplication coefficient x is supplied from the control means 5 in FIG. 1. The output signals siginA, siginB from the modulating blocks 40A, 40B are input to positive inputs of the adders 54, 51 to thereby excite signals in the closed-loop signal propagation path.

The adder 51 calculates a difference between the output signal siginA from the modulating block 40A and the signal consigA from the multiplier 56. The delay circuit 52 delays the difference signal from the adder 51. The multiplier 53 multiplies the delayed signal from the delay circuit 52 by the multiplication coefficient x to form the signal consigB. The adder 54, delay circuit 55, and multiplier 56 function similarly to the above to form the signal consigA.

The signal consigA delivered from the adder 56 is input to the multiplier 42 of the modulating block 40A. The signal consigB delivered from the multiplier 53 is input to the modulating block 40B. That is, the output signals siginA, siginB from the modulating blocks 40A, 40B which are associated with the respective waveguide networks are input to the connecting block 50 where they are subjected to signal processing as described above, and the resulting signals are fed back to the modulating blocks 40A, 40B. Further, the output signals siginA, siginB are fed back to the respective waveguide networks 1A, 1B Thus, musical tone signals circulating in the respective waveguide networks 1A and 1B exert influence on each other via the connection means 3. The coefficient k of the multipliers 41, 42 corresponds to the degree of connection between the waveguide networks 1A, 1B such that as the coefficient k decreases, the degree of connection between the networks 1A and 1B decreases. To synthesize a musical sound to be generated when the hi-hat cymbals are closed, the coefficient k is set to a value close to 1 to thereby increase the degree of connection between the networks.

The multiplication coefficient x of the multipliers 53, 56 determines a loss occurring at the connecting block and is also related to the degree of connection. When the multiplication coefficient x is set to a smaller value, the loss caused by the connection between the networks increases, which accelerates attenuation of the signals and also changes the tone color.

Although in the example illustrated in FIG. 4, the connecting block 50 is formed by a closed-loop signal propagation path, this is not limitative, but the networks may be connected together in other manners. For example, the output signals siginA, siginB from the modulating blocks 40A, 40B may be added to an adder, and the resulting sum signal may be used as the output signals consigA and the consigB.

Next, the arrangement and functions of the modulation signal-generating means 4 will be described with reference to FIG. 5A.

Figure 5A:
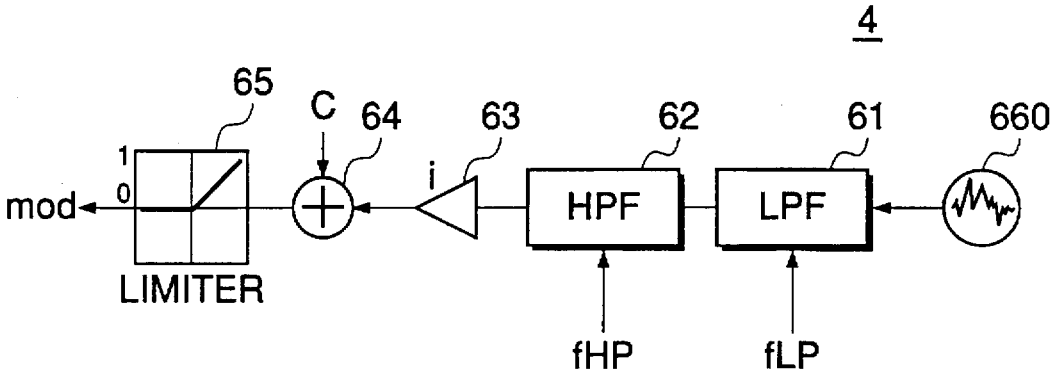
FIG. 5A shows a block diagram showing the arrangement of modulation signal-generating means appearing in FIG. 1.

Referring to FIG. 5A, the modulation signal-generating means 4 is comprised of a noise generator 60, a low-pass filter 61, a high-pass filter 62, a multiplier 63, an adder 64, and a limiter 65. The noise generator 60 generates a noise signal which changes at random with respect to time. The noise signal is applied via the low-pass filter 61 and the high-pass filter 62 to the multiplier 63. The low-pass filter 61 and the high-pass filter 62 are supplied with signals indicative of cut-off frequencies fLP, fHP from the control means 5, respectively, to determine the cut-off frequencies thereof.

The multiplier 63 multiplies the input filtered noise signal by a multiplication coefficient i supplied from the control means 5 in FIG. 1 and delivers the resulting signal to the adder 64. The adder 64 adds a signal c supplied from the control means 5 to the signal received from the multiplier 63 and delivers the resulting signal to the limiter 65. The limiter 65 limits the amplitude of the input signal to form the modulation signal mod and deliver the same.

As the magnitude of the signal c increases, the magnitude of the modulation signal mod increases. When the magnitude of the modulation signal mod increases to increase the coefficient k applied to the multipliers 41, 42 in FIG. 4, the influence of the signal consigA input from the connecting block 50 increases. This is equivalent to an increased degree of mutual influence between the two waveguide networks. For example, in the case of high-hat cymbals, the signal c corresponds to the degree of closure or closeness of the two cymbals. Further, the multiplication coefficient i of the multiplier 63 corresponds to a reaction component produced by collision of the two vibrating elements.

Thus, the degree of mutual influence or interference of the signals circulating in the two waveguide networks is controlled by the modulation signal mod. The modulation signal mod varies in a random manner as time elapses, so that the degree of mutual influence between the waveguide networks also varies in a random manner as time elapses. By thus varying the degree of mutual influence between the waveguide networks in a random manner as time elapses, it is possible to simulate mutual interference between two vibrating elements of a musical instrument which generates musical tones through complicated mutual interference between the two vibrating elements.

Although in the above described embodiment, the modulation signal mod is formed based on the noise signal from the noise generator, this is not limitative, but the modulation signal mod may be formed based on an output signal from a waveguide network.

Figure 5B:
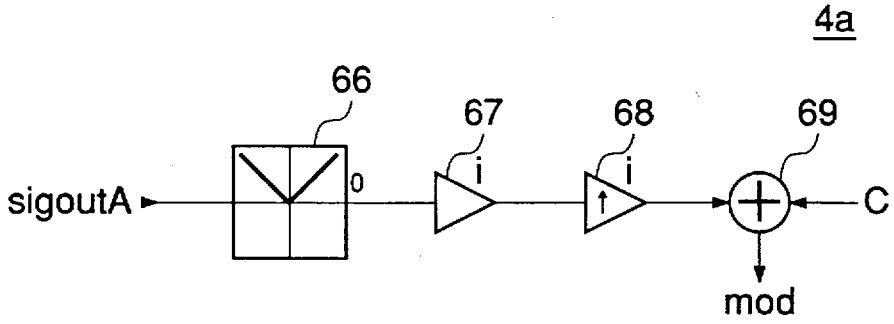
FIG. 5B shows a block diagram showing the arrangement of modulation signal-generating means according to another embodiment of the invention.

FIG. 5B shows the arrangement of a modulation signal-generating means 4*a* which is adapted to form the modulation signal mod based on an output signal from a waveguide network. The modulation signal-generating means 4*a* is formed of a limiter 66, a multiplier 67, a level shifter 68, and an adder 69.

The limiter 66 is supplied with the output signal sigoutA from the waveguide network 1A in FIG. 1 and limits the amplitude of the signal sigoutA. The signal thus limited in amplitude is input to the multiplier 67, which in turn multiplies the input signal by the multiplication coefficient i. The output signal from the multiplier 67 is input to the level shifter 68, wherein the level of the input signal is shifted.

An output signal from the level shifter 68 is input to the adder 69. The adder 69 adds together the output signal from the level shifter 68 and the control signal c from the control means 5 to form the modulation signal mod. The control signal c represents the influence of a mechanical connection or the like which is independent of vibrations of the vibrating elements.

If the modulation signal mod is thus generated based on the output signal from a waveguide network, the degree of mutual influence between the waveguide networks varies in response to a signal circulating in the waveguide network. If this example is applied to an actual musical instrument, the above variation of the degree of mutual influence between the waveguide networks corresponds to variation of the degree of mutual influence between vibrating elements depending on vibrations of the vibrating element. This makes it possible to synthesize more real musical tones.

Alternatively, a combination of the modulation signal-generating means shown in FIGS. 5A and 5B may be employed. Assuming that coefficients determined by the modulation signals mod delivered from the modulation signal-generating means 4 and 4*a* are designated by k1 and k2, respectively, the coefficient k of the multipliers 41 and 42 may be set to k1+k2 or k1×k2.

The limiter 65 in FIG. 5A and the limiter 66 in FIG. 5B subject the input signals to half-wave rectification and full-wave rectification, respectively, to limit the amplitude thereof such that the multiplication coefficient k of the multipliers 41, 42 in FIG. 4 assumes a value within a range of 0 to 1. The limiters 65, 66 may carry out either half-wave rectification or full-wave rectification, or may not carry out any rectification.

Although in the embodiment illustrated in FIG. 1, two waveguide networks are employed, this is not limitative, but the musical tone-synthesizing apparatus of the present invention may incorporate three or more waveguide networks. When three or more waveguide networks are employed, a plurality of connection means are provided to connect between respective corresponding waveguide networks.

Although in the embodiment described above, the control signals c, i, m and x are supplied from the control means 5 to corresponding blocks, this is not limitative, but these control signals may be varied as time elapses, depending on a manner of performance made via the performance operating element. For example, the control signals may be changed as time elapses by means of an envelope generator or an interpolating oscillator. By thus changing the control signals in a time-varying manner, it is possible to generate musical tone signals dependent on the manner of performance.

Although the above given description of the embodiments refers to an example of synthesizing a sound of hi-hat cymbals, this is not limitative, but a sound of an instrument having a plurality of vibrating elements such as a guitar having a plurality of strings may be synthesized. Further, the present invention may be applied not only to synthesization of ordinary instrument musical tones but also to synthesization of musical tones from an effecter.

The waveguides, connection means, and modulation signal-generating means may be realized by hardware, or by software, i.e. a program for signal processing carried out by a digital signal processor (DSP). They may also be implemented by a hybrid construction of hardware and software.

Having described the invention as related to the embodiments shown in the accompanying drawings, the invention should not be limited to any of the details of description unless otherwise specified, but various changes, modifications, combinations, etc. may be made in the invention without departing the spirit and scope thereof.

What is claimed is:

1. A musical tone-synthesizing apparatus comprising:

a plurality of waveguide networks each including at least one waveguide, each of said waveguides having a closed loop in which a signal circulates as a circulating signal in response to an external excitation signal, said closed loop having an output through which said circulating signal is output as a waveguide output signal, and an input through which a signal is input to be superposed on said circulating signal each waveguide network further including signal-forming means for forming a network output signal based on said waveguide output signal, modulating signal-generating means for carrying out signal processing on an externally provided noise signal to form an external modulating signal, and connection means connected to said waveguide networks, for carrying out signal processing on said network output signal delivered from each of said waveguide networks, based on the external modulating signal, and for inputting the resulting processed signal to said input of said closed loop of said at least one waveguide of each of said waveguide networks, said connection means controlling connection characteristics of said plurality of waveguide networks based on said external modulating signal.

2. A musical tone-synthesizing apparatus according to claim 1, wherein said modulating signal-generating means further carries out signal processing on said network output signal from one of said corresponding ones of said waveguide networks to form said modulating signal.

3. A musical tone-synthesizing apparatus according to claim 1, wherein said connection means includes a connection block having a closed loop, and a plurality of modulating blocks connected, respectively, to said corresponding ones of said waveguide networks, each of said modulating blocks forming a modulating block output signal based on said network output signal from a corresponding one of said corresponding ones of said waveguide networks and said modulating signal and delivering said modulating block output signal to said closed loop of said connection block and said closed loop of said at least one waveguide of said corresponding one of said corresponding ones of said waveform networks, said connection block forming feedback signals based on said modulating block output signal from one of said modulating blocks and said modulating block output signal from another one of said modulating blocks and delivering said feedback signals, respectively, to said another one of said modulating blocks and said one of said modulating blocks, said modulating blocks each mixing said network output signal and said feedback signal at a ratio dependent on said modulating signal to form said modulating block output signal.

4. A musical tone-synthesizing apparatus according to claim 3, wherein said feedback signal delivered from said one of said modulating blocks is formed by multiplying said modulating block output signal from said another one of said modulating blocks by a predetermined coefficient, and said feedback signal delivered from said another one of said modulating blocks is formed by multiplying said modulating block output signal from said one of said modulating blocks by a predetermined coefficient.

5. A musical tone-synthesizing apparatus according to claim 3, wherein said feedback signal delivered from said one of said modulating blocks is formed by adding together said modulating block output signal from said one of said modulating blocks and said modulating block output signal from said another one of said modulating blocks, and said feedback signal delivered from said another one of said modulating blocks is formed by adding together said modulating block output signal from said one of said modulating blocks and said modulating block output signal from said another one of said modulating blocks.

* * * * *